US012680247B2

(12) United States Patent
Schmidt et al.

(10) Patent No.: US 12,680,247 B2
(45) Date of Patent: Jul. 14, 2026

(54) CURB BROOM DEVICE AND SYSTEM

(71) Applicants: Erich Schmidt, Sioux Falls, SD (US); Ryan Merrill, Canistota, SD (US); Greg Ryken, Yankton, SD (US)

(72) Inventors: Erich Schmidt, Sioux Falls, SD (US); Ryan Merrill, Canistota, SD (US); Greg Ryken, Yankton, SD (US)

(73) Assignee: CMC Equipment, Inc., Columbia, SD (US)

( * ) Notice: Subject to any disclaimer, the term of this patent is extended or adjusted under 35 U.S.C. 154(b) by 343 days.

(21) Appl. No.: 18/602,526

(22) Filed: Mar. 12, 2024

(65) Prior Publication Data

US 2025/0179748 A1 Jun. 5, 2025

Related U.S. Application Data

(63) Continuation-in-part of application No. 17/964,865, filed on Oct. 12, 2022, now Pat. No. 12,637,817.

(51) Int. Cl.

| | |
|---|---|
| ***E01H 1/05*** | (2006.01) |
| ***A46B 13/00*** | (2006.01) |
| ***A46B 13/02*** | (2006.01) |

(52) U.S. Cl.

CPC ..... *E01H 1/056* (2013.01); *A46B 13/001* (2013.01); *A46B 13/02* (2013.01); *A46B 2200/3066* (2013.01)

(58) Field of Classification Search

CPC ..... E01H 1/056; A46B 13/001; A46B 13/02; A46B 2200/3066

See application file for complete search history.

(56) References Cited

U.S. PATENT DOCUMENTS

| | | | | |
|---|---|---|---|---|
| 6,622,336 | B2 | 9/2003 | Jackson | |
| 8,422,682 | B2 | 4/2013 | Ortiz Cornet et al. | |
| 2005/0102778 | A1 | 5/2005 | Gregerson | |
| 2014/0245644 | A1* | 9/2014 | Kois | E01H 1/05 172/810 |

FOREIGN PATENT DOCUMENTS

| | | |
|---|---|---|
| CN | 205776012 | 12/2016 |
| CN | 107338751 | 11/2017 |
| CN | 207739197 | 8/2018 |
| CN | 211430504 | 9/2020 |
| WO | 2010018271 | 2/2010 |

* cited by examiner

*Primary Examiner* — Andrew A Horton
(74) *Attorney, Agent, or Firm* — Jeffrey A. Proehl; Woods, Fuller, Shultz & Smith PC

(57) ABSTRACT

A curb brush device for sweeping a newly formed curb includes a frame for attachment to a vehicle such that the frame extends forwardly from the vehicle. The frame includes a frame attachment bracket and a rail coupled to the frame attachment bracket. A brush arm is coupled to the rail and is extendable laterally from the rail. A brush is coupled to the brush arm. The brush is rotatable for sweeping a surface laterally offset from the vehicle.

10 Claims, 12 Drawing Sheets

CURB BROOM DEVICE AND SYSTEM

REFERENCE TO RELATED APPLICATIONS

This application is a continuation-in-part of U.S. Non-provisional patent application Ser. No. 17/964,865, filed Oct. 12, 2022, the disclosure of which is hereby incorporated by reference in its entirety.

BACKGROUND

Field

The disclosure relates to brush devices and more particularly pertains to a new system including a brush device and system for offset sweeping of surfaces, such as a newly formed curb.

Description of the Prior Art

The prior art relates to brush devices. Known prior art lacks an offset and elevated brush to allow a conventional skidsteer or similar vehicle to sweep and clear debris from a newly formed curb. Known prior art also lacks a capability to adapt to the position in configuration of the surface of the curb with respect to the adjacent ground surface over which the vehicle travels.

SUMMARY

An embodiment of the disclosure meets the needs presented above by generally comprising a frame for attachment to a vehicle such that the frame extends forwardly from the vehicle. The frame includes a frame attachment bracket and a rail coupled to the frame attachment bracket. A brush arm is coupled to the rail and is extendable laterally from the rail. A brush is coupled to the brush arm. The brush is rotatable for sweeping a surface laterally offset from the vehicle.

In another aspect, the disclosure relates to a sweeping system which may comprise a curb brush device for attachment to a vehicle having a forward direction of movement. The curb brush device may comprise a frame configured for attachment to the vehicle such that the frame extends forwardly from the vehicle. The frame may include a frame attachment bracket and a rail pivotally coupled to the frame attachment bracket such that the rail pivots with respect to the frame attachment bracket about a substantially vertical axis when the curb brush device is attached to the vehicle for use. The device may also include a brush arm coupled to the rail, with the rail and brush arm extending transversely with respect to the forward direction of movement of the vehicle when the curb brush device is attached to the vehicle for use, the brush arm being movable along the rail in a direction lateral to the forward direction of movement. The device may further include a brush assembly mounted on the brush arm to move with the brush arm in the lateral direction to a position laterally offset from the vehicle when the curb brush device is attached to the vehicle for use. The brush assembly may include a brush rotatable about a rotation axis with respect to the brush arm. The device may include a roll axis orientation adjustment assembly configured to adjust a roll orientation of the brush assembly about a roll axis with respect to the brush arm, with the roll axis being oriented substantially perpendicular to the rotation axis of the brush.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
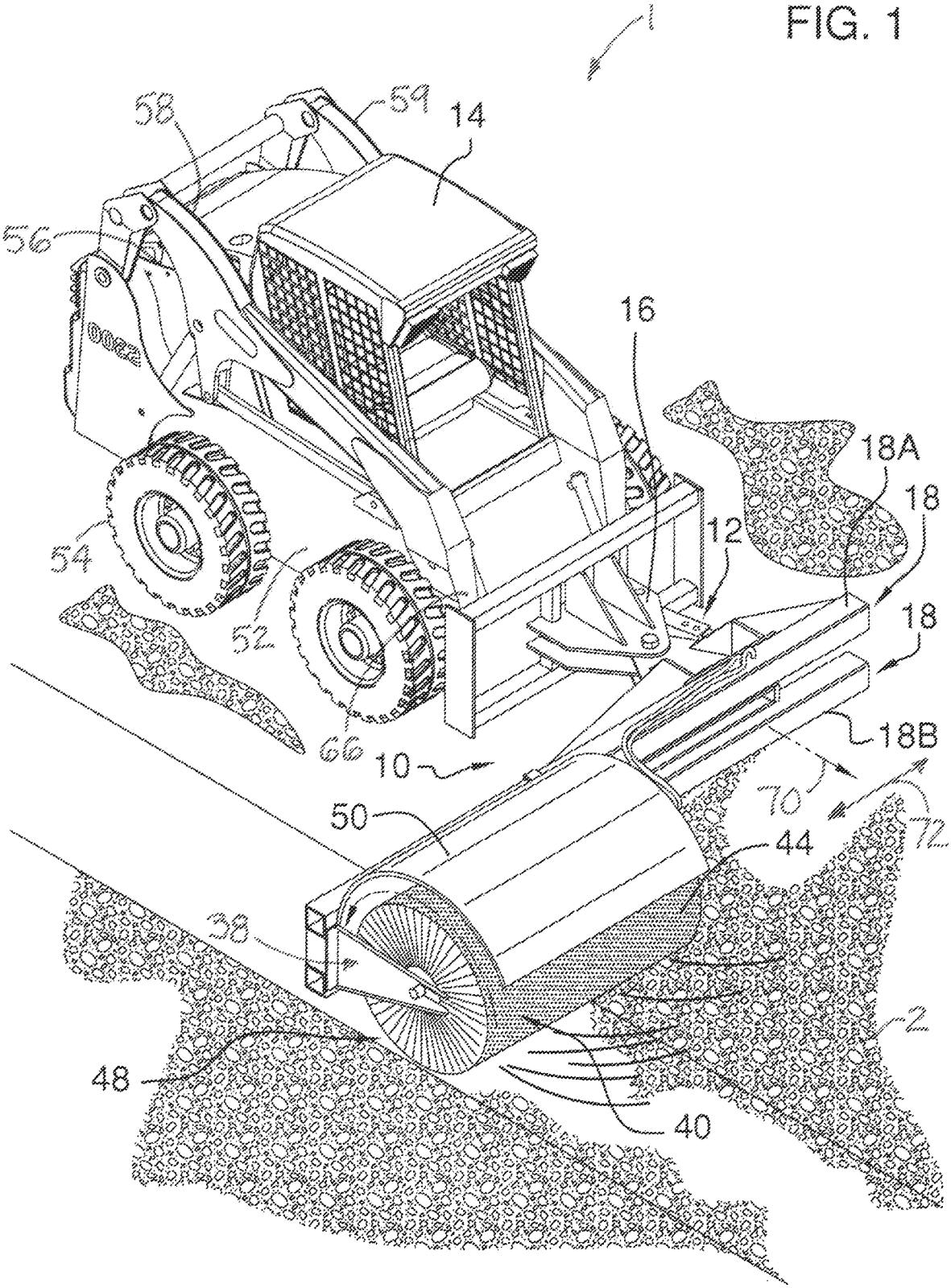
FIG. 1 is a schematic top front side perspective view of a system including a curb brush device and the vehicle carrying the brush device, according to an embodiment of the disclosure in use.
Figure 2:
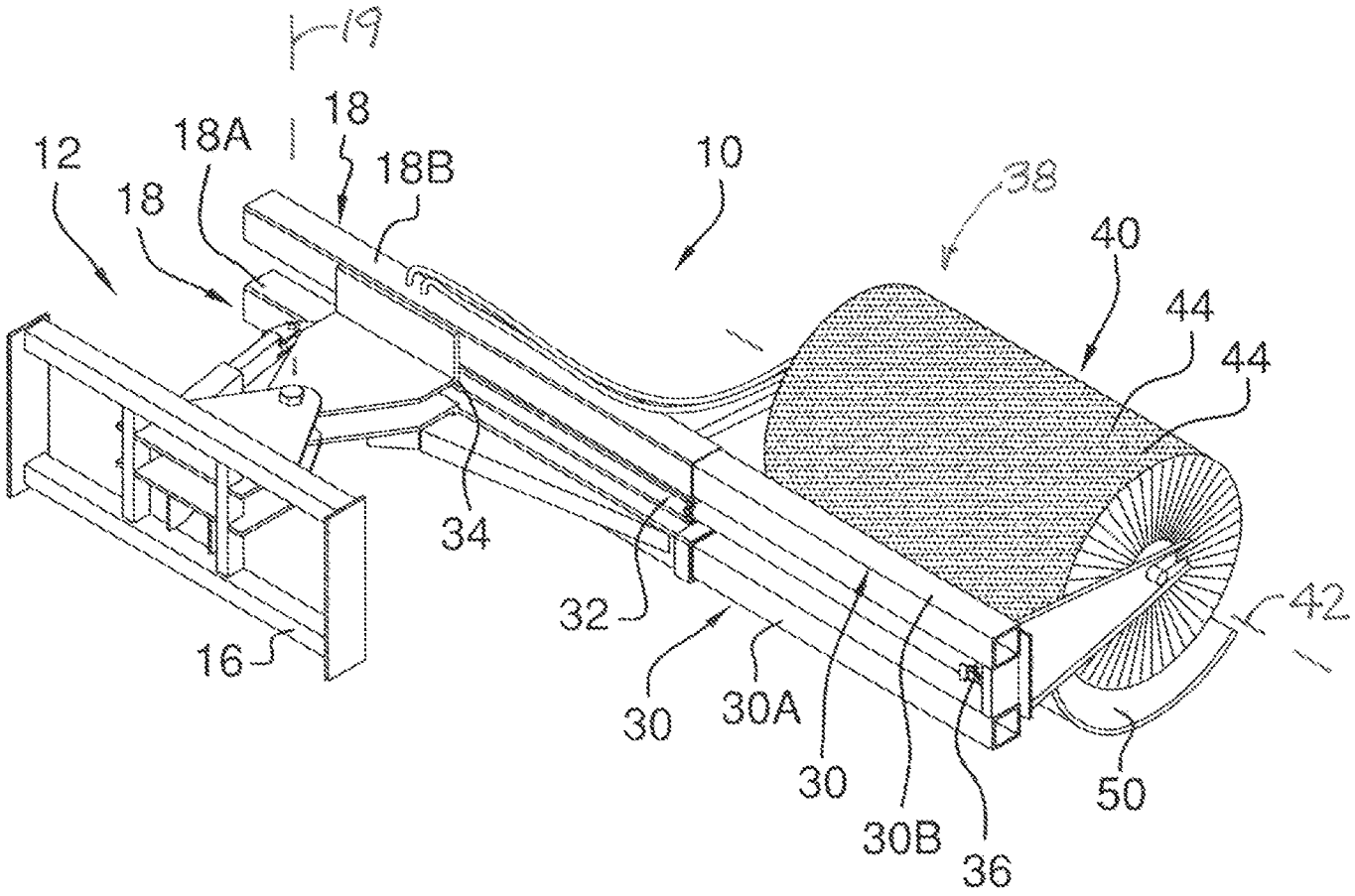
FIG. 2 is a schematic bottom rear side perspective view of an embodiment of the curb brush device of the disclosure.
Figure 3:
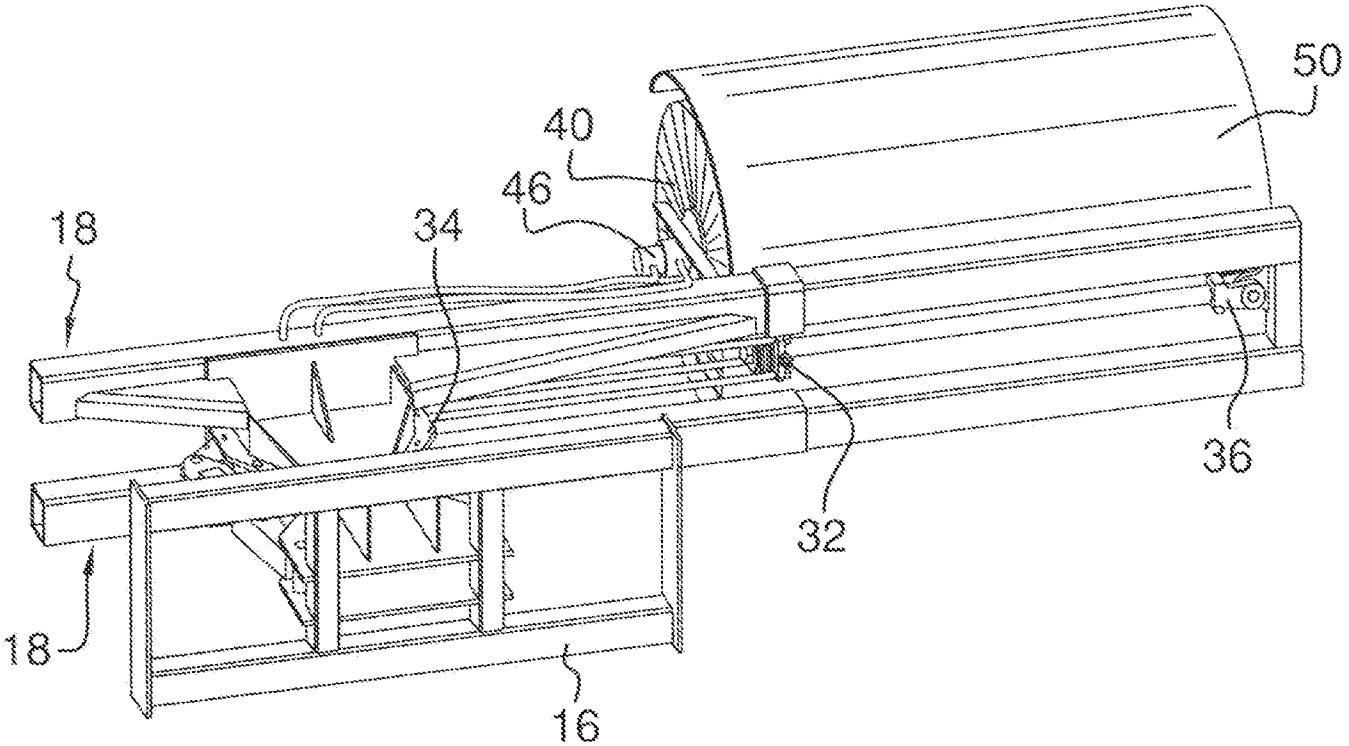
FIG. 3 is a schematic top rear side perspective view of an embodiment of the curb brush device of the disclosure.

With reference now to the drawings, and in particular to FIGS. 1 through 12 thereof, a new brush device embodying the principles and concepts of an embodiment of the disclosure will be described.

As best illustrated in FIGS. 1 through 12, the disclosure relates to a system 1 which may include a curb brush device 10 and may also include a vehicle 14 movable over a ground surface 2 which may be adjacent to a curb. The curb brush device 10 generally comprises a frame 12 which is configured for attachment to the vehicle 14 such that the frame 12 extends forwardly from the vehicle 14. The manner of attachment is conventional and known for attaching other accessories such as plows and the like. The frame 12 includes a frame attachment bracket 16 and a rail 18 coupled to the frame attachment bracket 16.

The rail 18 is pivotally coupled to the frame attachment bracket 16 to allow the rail 18 to be positioned at a desired yaw angle relative to the frame attachment bracket 16. The yaw orientation of the rail 18 (and other elements of the brush device 10) with respect to the frame 12 (and the vehicle 14) may be adjustable about a substantially vertical yaw axis 19.

Figure 6:
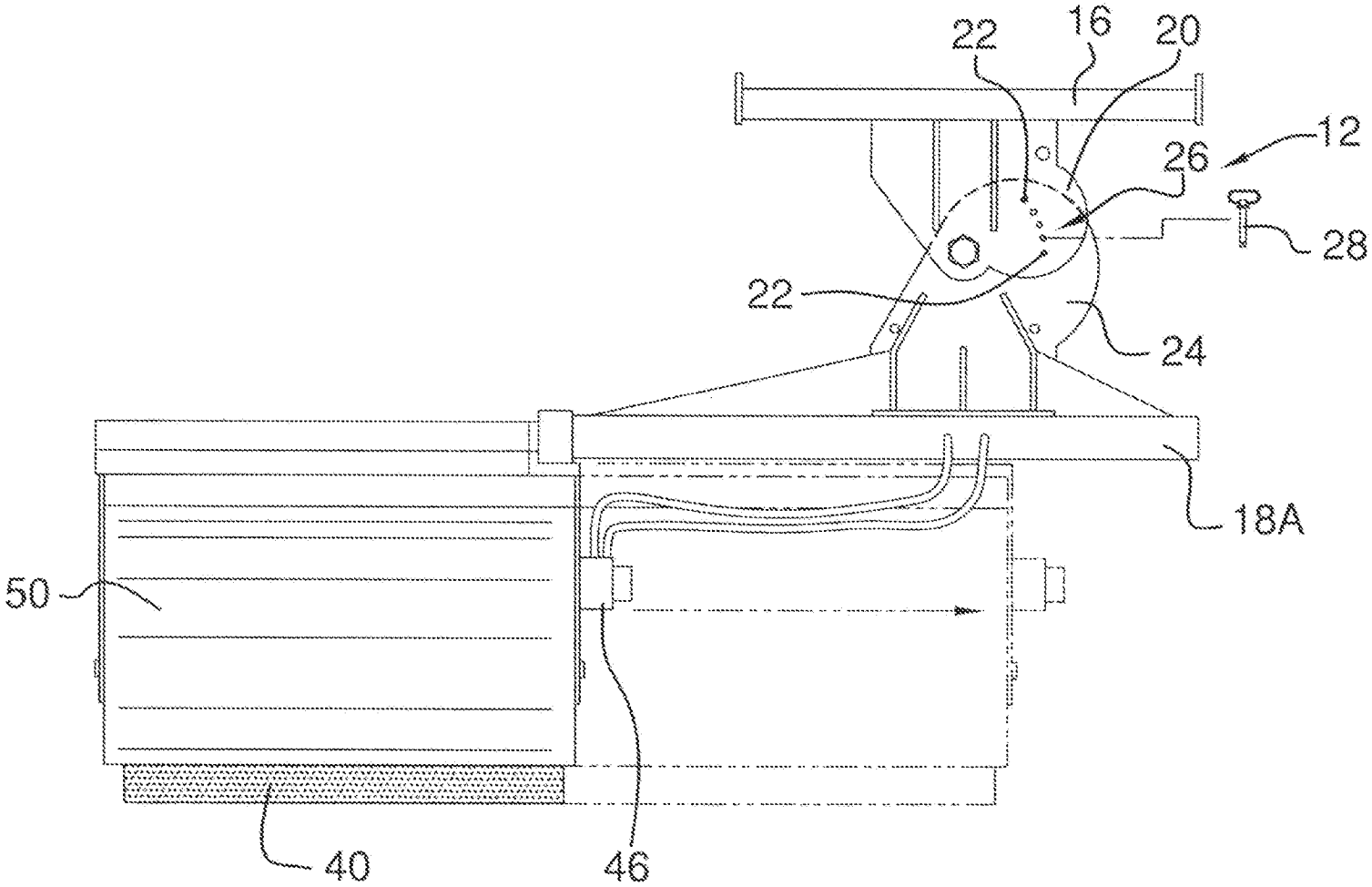
FIG. 6 is a schematic top view of an embodiment of the curb brush device of the disclosure.
Figure 7:
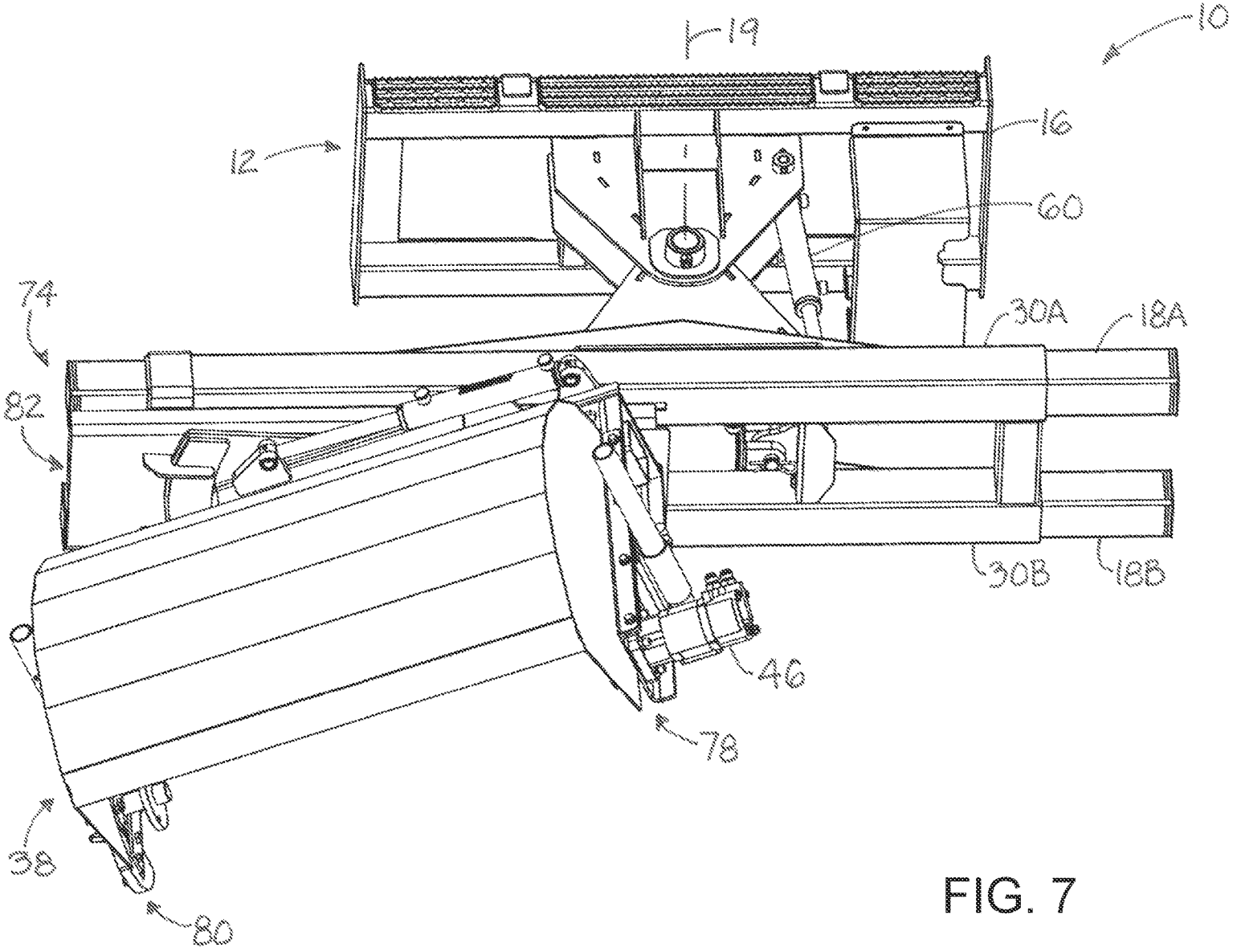
FIG. 7 is a schematic upper perspective view of another embodiment of the curb brush device, shown without the brush for clarity purposes, according to the present disclosure.
Figure 8:
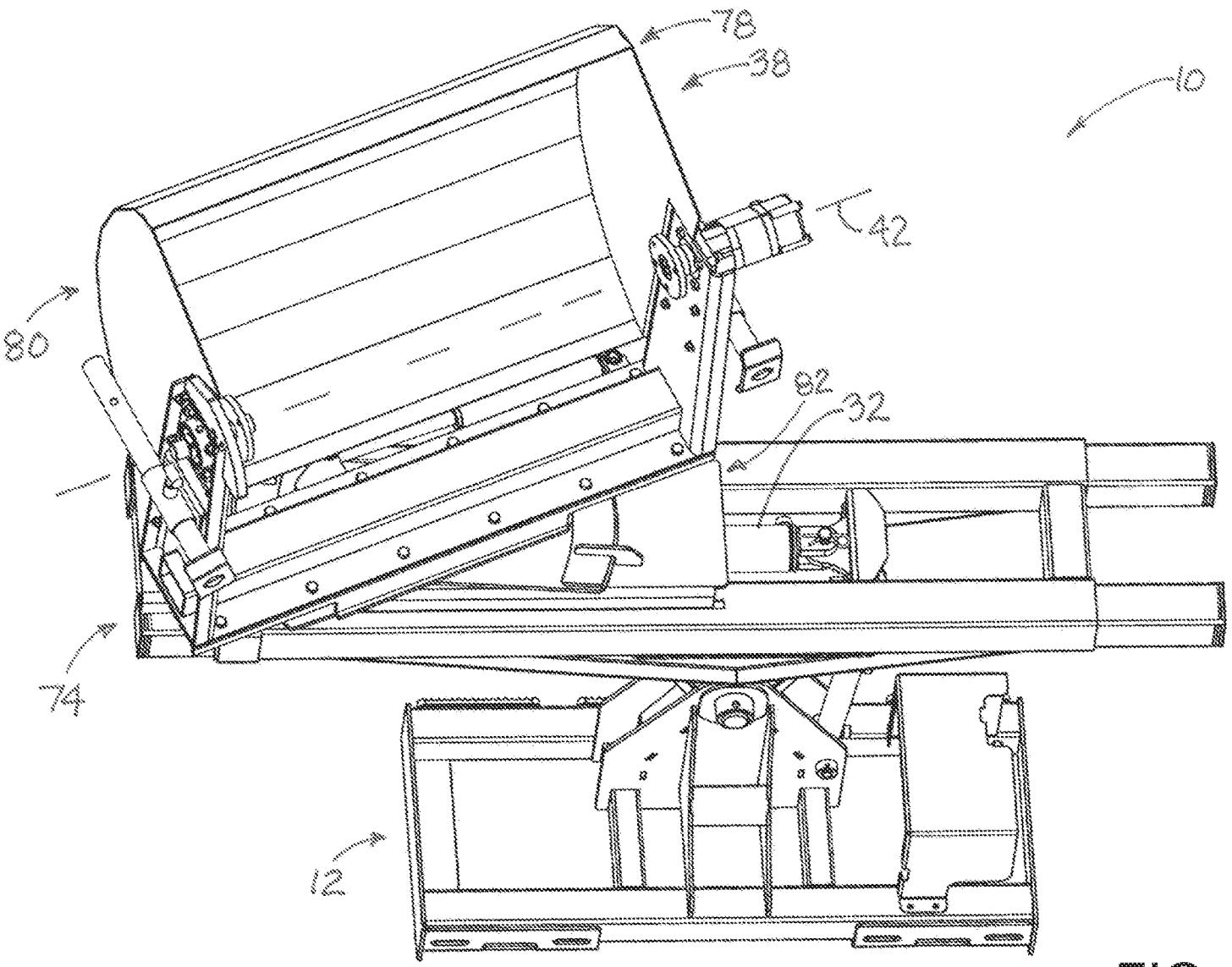
FIG. 8 is a schematic lower perspective view of the curb brush device of FIG. 7, according to an illustrative embodiment.
Figure 9:
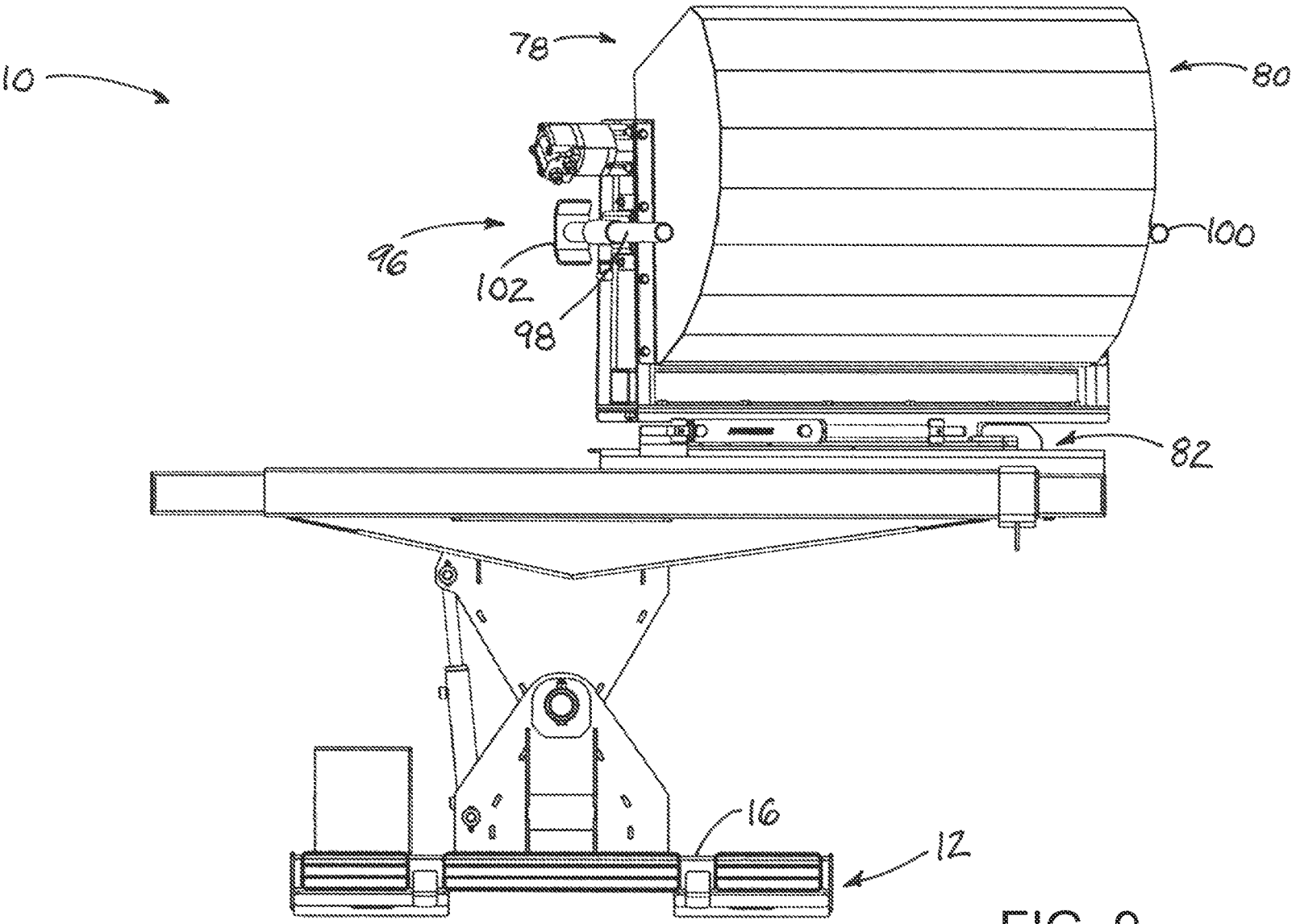
FIG. 9 is a schematic top view of the curb brush device of FIG. 7, according to an illustrative embodiment.
Figure 10:
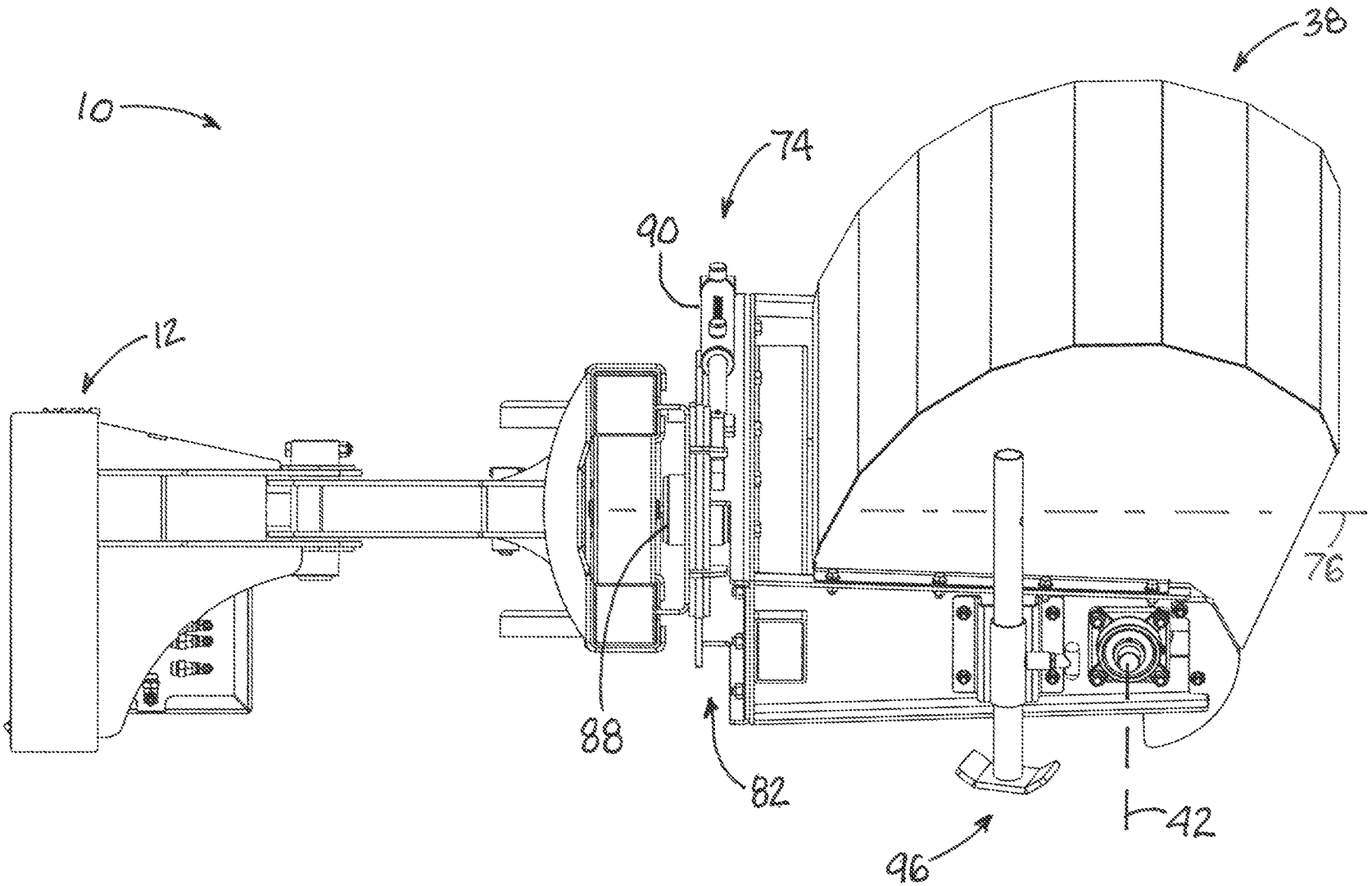
FIG. 10 is a schematic first side view of the curb brush device of FIG. 7, according to an illustrative embodiment.
Figure 11:
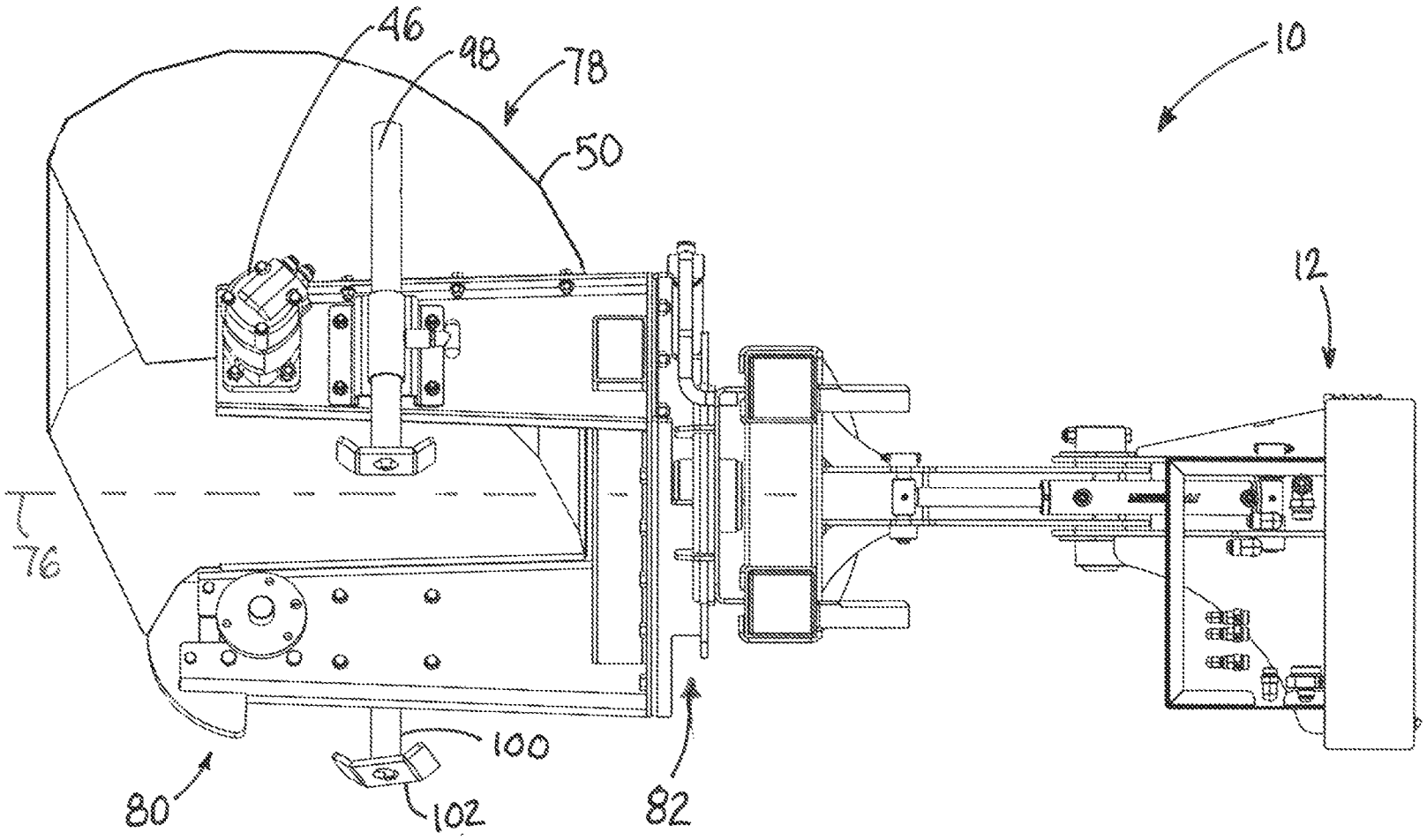
FIG. 11 is a schematic second side view of the curb brush device of FIG. 7, according to an illustrative embodiment.

In embodiments such as illustrated in FIG. 6, adjustment of the yaw orientation may be accomplished utilizing structure including a bracket plate 20 coupled to the frame attachment bracket 16. The bracket plate 20 has a plurality of bracket plate holes 22. The bracket plate holes 22 are radially arranged about a yaw pivot point between the frame attachment bracket 16 and the rail 18. A rail plate 24 is coupled to the rail 16 and is overlapped with the bracket plate 20. The rail plate 24 has an aperture 26 positionable to align with a selectable one of the bracket plate holes 22. A pin 28 is insertable through the selectable one of the bracket holes 22 and the aperture 26 wherein the pin 28 inhibits pivoting of the rail 18 relative to the frame attachment bracket 16.

Figure 4:
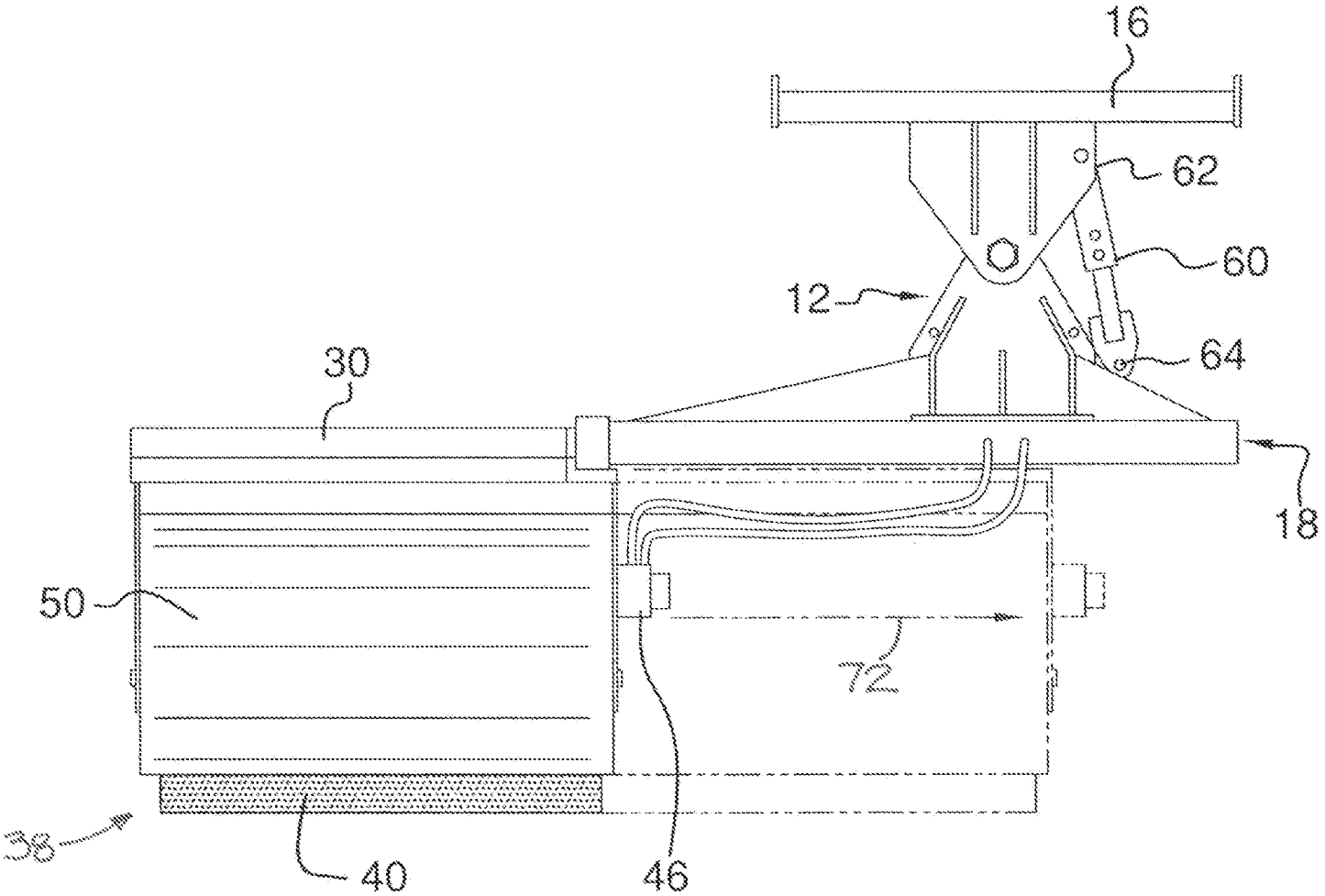
FIG. 4 is a schematic top view of an embodiment of the curb brush device of the disclosure.
Figure 5:
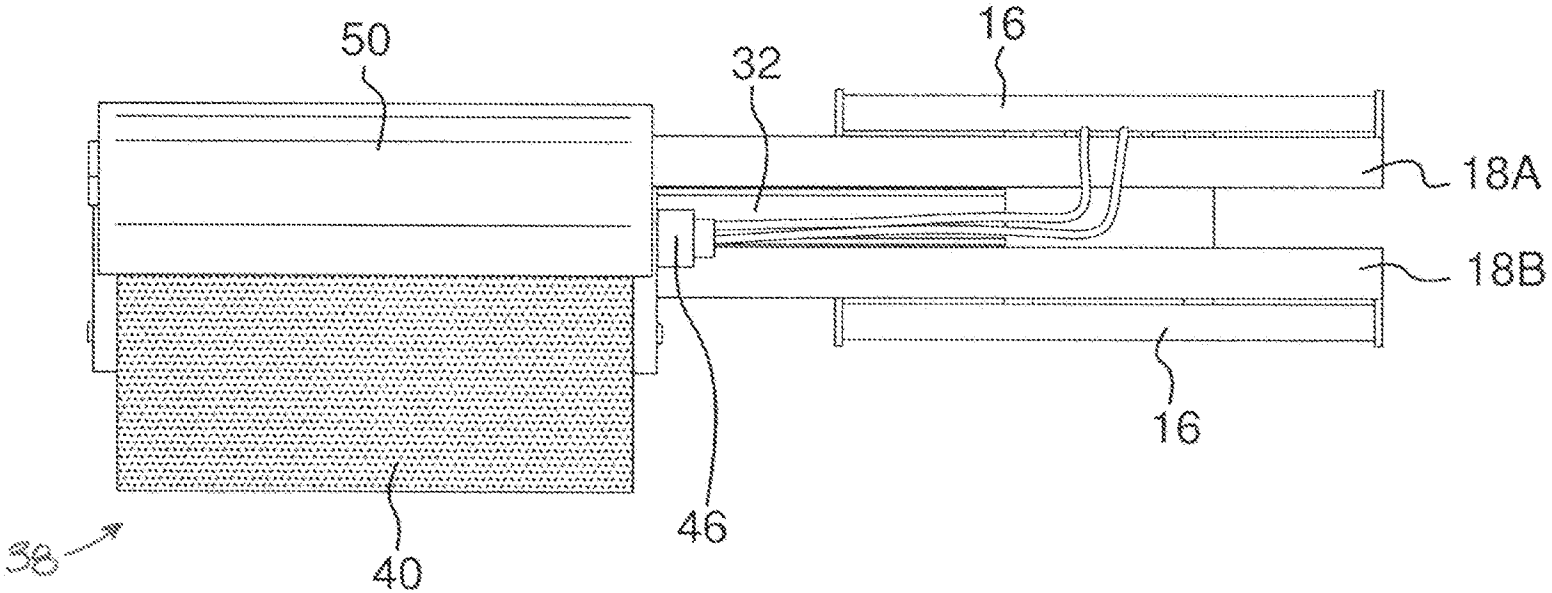
FIG. 5 is a schematic front view of an embodiment of the curb brush device of the disclosure.

In embodiments such as illustrated in FIG. 4, adjustment of the orientation may be accomplished utilizing structure including a pivot ram 60 having a first end 62 coupled to the frame attachment bracket 16 and a second end 64 coupled to the rail 18 wherein extension and retraction of the pivot ram 60 adjusts the yaw angle between the frame attachment bracket 16 and the rail 18. The pivot ram 60 is hydraulic and configured for hydraulic coupling to the hydraulic system of the vehicle 14 so that the pivot ram 60 can be controlled conventionally using a connection to a hydraulic system of the vehicle 14.

A brush arm 30 is coupled to the rail 18. The brush arm 30 extends laterally from the rail 18. The brush arm 30 is adjustably extendable from the rail 18. An extension ram 32 has a primary end 34 coupled to the rail 18 and a secondary end 36 coupled to the brush arm 30. Extension and retraction of the extension ram 32 adjusts a length of extension of the brush arm 30 from the rail 18. The extension ram 32 is hydraulic and configured for hydraulic coupling to the hydraulic system of the vehicle 14.

The curb brush device including a brush assembly 38 mounted on the brush arm 30 to move with the brush arm in a lateral direction between a retracted position and an extended position, as shown, for example, in FIGS. 4 and 6). The brush assembly 38 including a brush 40 rotatable about a rotation axis 42 such that the brush 40 is configured for sweeping a surface 42 laterally offset from the vehicle 14. The brush 40 is cylindrical and includes a plurality of bristles 44 arranged and extending radially relative to a central axis of the brush 40. The plurality of bristles 44 is flexible, wherein the brush 40 is configured for conforming to a shape of a curb formed by the surface 42 laterally offset from the vehicle 14. The brush assembly 38 may also include a motor 46 coupled to the brush arm 30. The motor 46 is operationally coupled to the brush 40 wherein the motor 46 rotates the brush 40. The motor 46 is hydraulic and configured for hydraulic coupling to the hydraulic system of the vehicle 14 using conventional hydraulic lines as are commonly known and used for control of other types of accessories such as a plow or the like. The brush 40 is rotated by the motor 46 such that a bottom 48 of the brush 40 moves in a forward direction on the surface 42 laterally offset from the vehicle 14. This drives debris on the surface 42 forward leaving the surface clear of dirt and debris as the brush 40 passes over the surface 42 in a forward direction. The brush assembly 38 may also include a cover 50 coupled to the brush arm 30. The cover 50 is arcuate such that the cover 50 is positioned concentric with respect to the brush 40. The cover 50 extends upwardly and forwardly from the brush arm 30 wherein the cover 50 extends from the brush arm 30 over a top of the brush 40.

In embodiments, the rail 18 may be one of a pair of rails 18A, 18B. The pair of rails 18A, 18B is parallel and horizontally oriented. The brush arm 30 may similarly be one of a pair of brush arms 30A, 30B. Each brush arm 30 of the pair of brush arms 30A, 30B is coupled to and extendable from a respective rail of the pair of rails 18A, 18B.

In the illustrative embodiments, the vehicle 14 includes a vehicle frame 52 and a plurality of wheels 54 that are rotatably mounted on the frame for supporting the frame 12 of the vehicle on the ground surface 2. The vehicle 14 may also include a hydraulic power system 56 which is configured to generate hydraulic power in the form of pressurized hydraulic fluid for use in operating elements of the vehicle as well as elements of the curb brush device, such as the extension ram 32, the pivot ram 60, and the motor 46. Illustratively, the hydraulic power system 56 may be operated by an engine of the vehicle. The vehicle may also include at least one, and typically a pair of, lift arms 58, 59 which are pivotally mounted on the vehicle frame 52. Each of the lift arms 58, 59 may have a forward end 66 which is positioned forward of the vehicle frame 52 to be engaged by the frame 12 of the brush device.

In general, the vehicle 14 has a forward direction 70 of movement during operation of the vehicle. The rail 18 and the brush arm 30 may extend transversely with respect to the forward direction 70 of movement of the vehicle. The rail 18, the brush arm 30, and the extension ram 32 may permit adjustment of the brush assembly 38 in a lateral direction 72 with respect to the forward direction of movement, and the adjustment may be substantially in a horizontal direction. The brush assembly 38 may thus be adjustable to a position laterally offset from the frame 12 of the brush device (see, e.g., FIG. 1), and may also be adjustable to a position that is laterally offset from the vehicle 14.

The curb brush device 10 may also include a roll axis orientation adjustment assembly 74 which is configured to adjust a roll orientation of the brush assembly about a roll axis 76 with respect to the brush arm, such as is illustrated in FIGS. 7 through 12. The roll axis 76 may be oriented substantially perpendicular to the rotation axis 42 of the brush 40. The brush assembly 38 may be elongated in a direction substantially parallel to the rotation axis 42, and the assembly 38 may have opposite inboard 78 and outboard 80 ends. Adjustment of the roll orientation of the brush assembly 38 may cause the inboard 78 and outboard 80 ends to raise and lower alternately with respect to the ground surface 2.

In embodiments, the adjustment structure 74 may include a rotational support structure 82 that is configured to permit rotation of the brush assembly 38 with respect to the brush arm 30 about the rotation axis 76. The rotational support structure 82 may include a first component 84 which is mounted on the brush arm 30, and a second component 86 mounted on the brush assembly 38. The support structure 82 may also include a pivot connection 88 which connects the second component 86 to the first component 84 in a manner that permits rotation of the second component with respect to the first component about the roll axis 76. The support structure 82 may further include a rotation actuator 90 which is configured to rotate the second component 86 with respect to the first component 84 to thereby rotate the brush assembly 38 attached to the second component with respect to the brush arm 30 attached to the first component. Illustratively, the rotation actuator 90 may have a first end 92 attached to the first component 84 and a second end 94 attached to the second component 86. The length of the rotation actuator 90 may be variable to cause rotation of the second component 86 with respect to the first component 84, thus rotating the brush assembly about the roll axis 76 and alternately lifting and lowering the inboard 78 and outboard 80 ends of the assembly 38.

Figure 12:
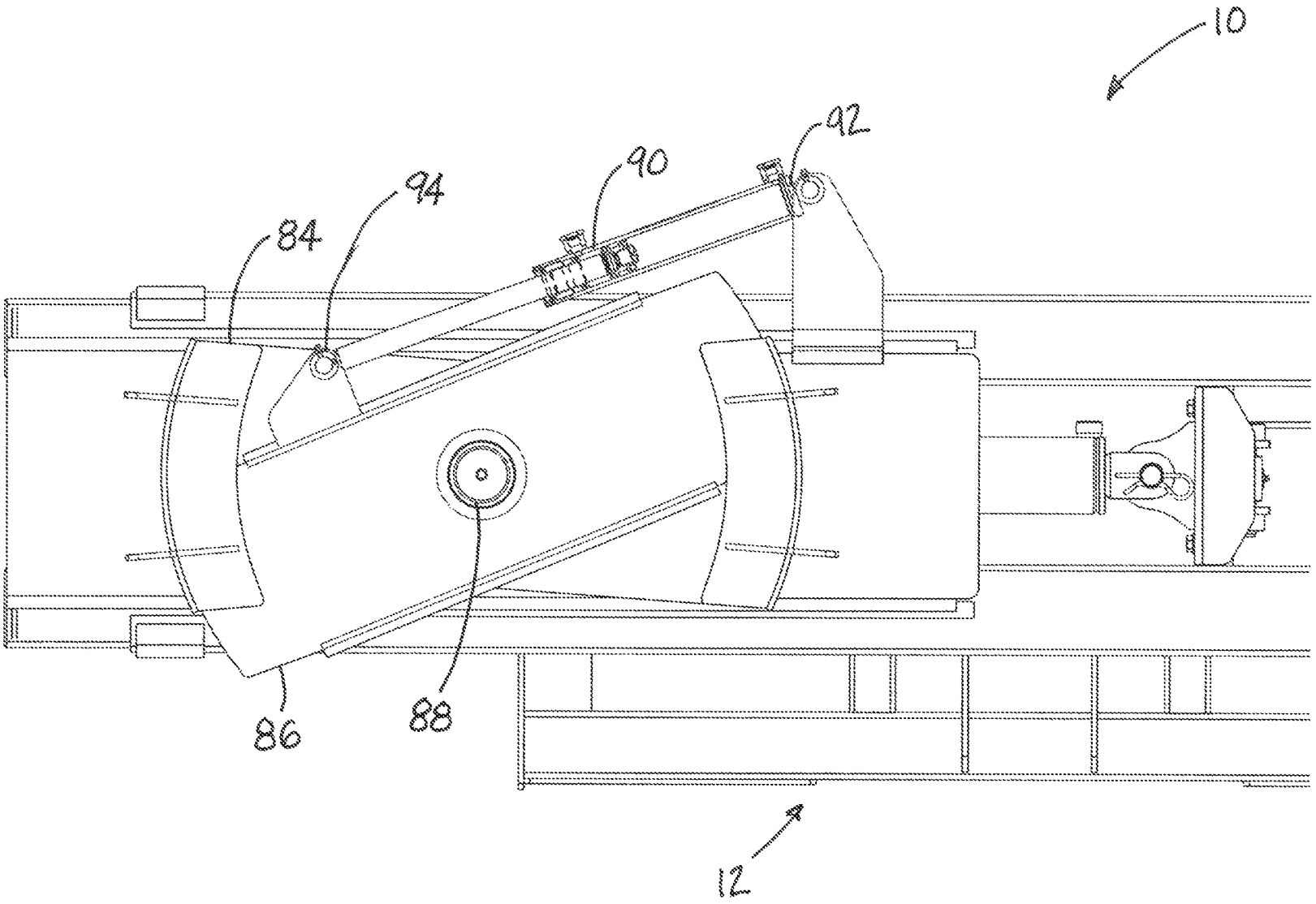
FIG. 12 is a schematic sectional view of the curb brush device of FIG. 7 taken along line 12-12 of FIG. 11, according to an illustrative embodiment.

In the illustrative embodiments, such as shown in FIG. 12, he first component 84 may comprise a first plate which may be stationary with respect to the brush arm 30 and may move with the brush arm in the lateral direction 72 with respect to the rail 18. The second component 86 may comprise a second plate which may be stationary with respect to the brush assembly 38, but rotates with respect to the first plate of the first component about the roll axis 76 by means of the pivot connection 88. Keeper or capture elements of the first component 84 may be fixedly mounted on the first plate and may extend partially about the second plate of the second component 86 to assist in maintaining the second plate adjacent to the first plate as the rotation actuator 90 rotates the second component with respect to the first component.

In embodiments, the brush assembly 38 may additionally include a landing support assembly 96 which is configured to selectively support the brush assembly on the ground surface 2. Illustratively, the landing support assembly 96 may comprise a first leg 98 mounted on the inboard end 78 of the brush assembly and a second leg 100 mounted on the outboard end 80 of the brush assembly. Each of the legs 98, 100 may extend in a direction that is oriented substantially perpendicular to the rotation axis 38 of the brush. Optionally, each of the legs 98, 100 terminates in a base skid 102 for contacting the ground surface 2. The degree of extension of each of the first and second legs with respect to the cover 50 may be adjustable to adjust the positions of the base skids with respect to the cover.

In use, the frame 12 is attached to the vehicle 14 and any hydraulic connections are made to the hydraulic system of the vehicle 14. The brush assembly 38 and the brush 40 on the brush arm 30 is extended laterally from the rail 18 and the vehicle 14. Additionally, the roll orientation of the brush assembly 38 may be adjusted utilizing the orientation adjustment assembly 74 to better conform the orientation of the brush 40 with respect to the surface to be engaged and brushed. The brush 40 is rotated by the motor 46 and the vehicle 14 is driven to pass the brush 40 over the ground surface 2.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the, specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the words "comprising" and "including" are used in their non-limiting sense to mean that items following the word are included, but items not specifically mentioned are not excluded.

A reference to an element by the indefinite article "a" does not exclude the possibility that more than one of the element is present, unless the context clearly requires that there be only one of the elements.

It should be appreciated that in the foregoing description and appended claims, that the terms "substantially" and "approximately," when used to modify another term, mean "for the most part" or "being largely but not wholly or completely that which is specified" by the modified term, and may be further quantified as values or qualities which deviate approximately 10 percent or less from the value or quality or relationship stated in the disclosure.

It should also be appreciated from the foregoing description that, except when mutually exclusive, the features of the various embodiments described herein may be combined with features of other embodiments as desired while remaining within the intended scope of the disclosure.

We claim:

1. A sweeping system comprising:

a curb brush device for attachment to a vehicle having a forward direction of movement, the curb brush device comprising:

a frame configured for attachment to the vehicle such that the frame extends forwardly from the vehicle, the frame including:

a frame attachment bracket; and a rail pivotally coupled to the frame attachment bracket such that the rail pivots with respect to the frame attachment bracket about a substantially vertical axis when the curb brush device is attached to the vehicle for use;

a brush arm coupled to the rail, the rail and brush arm extending transversely with respect to the forward direction of movement of the vehicle when the curb brush device is attached to the vehicle for use, the brush arm being movable along the rail in a direction lateral to the forward direction of movement;

a brush assembly mounted on the brush arm to move with the brush arm in the lateral direction to a position laterally offset from the vehicle when the curb brush device is attached to the vehicle for use, the brush assembly including a brush rotatable about a rotation axis with respect to the brush arm; and a roll axis orientation adjustment assembly configured to adjust a roll orientation of the brush assembly about a roll axis with respect to the brush arm, the roll axis being oriented substantially perpendicular to the rotation axis of the brush.

2. The system of claim 1 wherein the brush assembly is elongated with opposite inboard and outboard ends such that adjustment of the roll orientation of the brush assembly about the roll axis causes at least one of the inboard and outboard ends to raise and lower with respect to the ground surface.

3. The system of claim 2 wherein the brush assembly additionally includes a landing support assembly configured to selectively support the brush assembly on the ground surface, the landing support assembly comprising:

a first leg mounted on the inboard end of the brush assembly and a second leg mounted on the outboard end of the brush assembly, each of the legs extending in a direction oriented substantially perpendicular to the rotation axis of the brush.

4. The system of claim 3 wherein a degree of extension of each of the first and second legs with respect to a cover of the brush assembly being adjustable.

5. The system of claim 3 wherein each of the legs terminates in a base skid for contacting the ground surface.

6. The system of claim 1 wherein the roll axis orientation adjustment structure includes:

a rotational support structure configured to permit rotation of the brush assembly with respect to the brush arm, the rotational support structure including:

a first component mounted on the brush arm;

a second component mounted on the brush assembly;

a pivot connection connecting the second component to the first component in a manner permitting rotation of the second component with respect to the first component about the roll axis.

7. The system of claim 6 wherein the roll axis orientation adjustment structure additionally includes;

a rotation actuator configured to rotate the second component with respect to the first component to thereby rotate the brush assembly attached to the second component with respect to the brush arm attached to the first component.

8. The system of claim 1 wherein the curb brush device additionally comprises:

an extension ram having a primary end coupled to the rail and a secondary end coupled to the brush arm such that extension and retraction of the extension ram adjusts a degree of lateral offset of the brush assembly with respect to the vehicle when the curb brush device is attached to the vehicle.

9. The system of claim 1 wherein the curb brush device additionally comprises:

a pivot ram having a first end coupled to the frame attachment bracket and a second end coupled to the rail such that extension and retraction of the pivot ram adjusts a yaw angle between the frame attachment bracket and the rail.

10. The system of claim 1 additionally comprising:

a vehicle movable over a ground surface, the vehicle including:

a vehicle frame;

a plurality of wheels rotatably mounted on the frame for supporting the frame on the ground surface;

a hydraulic power system configured to generate hydraulic power in the form of pressurized hydraulic fluid;

a pair of lift arms pivotally mounted on the frame, each of the lift arms having a forward end positioned forward of the frame, the curb brush device being attached to the forward ends of the lift arms.

* * * * *